US006131582A

United States Patent [19]

Draghetti

[11] Patent Number: 6,131,582

[45] **Date of Patent: *Oct. 17, 2000**

[54] METHOD OF ROLLING CIGARETTE PORTIONS

[75] Inventor: Fiorenzo Draghetti, Medicina, Italy

[73] Assignee: G D Societa' per Azioni, Bologna, Italy

[ * ] Notice: This patent is subject to a terminal disclaimer.

[21] Appl. No.: 09/129,569

[22] Filed: Aug. 5, 1998

[30] Foreign Application Priority Data

Aug. 6, 1997 [IT] Italy ..... BO97A0498

[51] Int. Cl.[7] ..... A24C 1/16

[52] U.S. Cl. ..... 131/32; 131/27.1; 131/94

[58] Field of Search ..... 131/27.1, 28, 29, 131/32, 33, 56, 57, 88, 94; 493/45; 198/418, 418.3, 418.7, 427, 444, 445, 448, 458, 450

[56] References Cited

U.S. PATENT DOCUMENTS 3,080,871 3/1963 Molins et al. .
3,372,702 3/1968 Bohn .
4,841,993 6/1989 Hinz et al. .

*Primary Examiner*—Stanley S. Silverman
*Assistant Examiner*—Robert McBride
*Attorney, Agent, or Firm*—Marshall, O'Toole, Gerstein, Murray & Borun

[57] ABSTRACT

A method of rolling cigarette portions, wherein a first succession of first pairs of cigarette portions and a second succession of second pairs of cigarette portions are advanced in a direction crosswise to the respective axes of the cigarette portions, each first pair being defined by a first and a second cigarette portion coaxial with and a given distance from each other, the second succession being parallel to the first succession, and each second pair being defined by a third and a fourth cigarette portion coaxial with and the aforementioned distance from each other; the first pairs and the second pairs are partially engaged combfashion in a relative position in which each third cigarette portion is partially inserted between two adjacent second cigarette portions; a double filter and a respective projecting band are inserted between the first and second cigarette portions and between the third and fourth cigarette portions to form respective groups; and the groups, arranged in the first and second succession, are rolled along a common rolling bed to form double filter-tipped cigarettes.

6 Claims, 1 Drawing Sheet

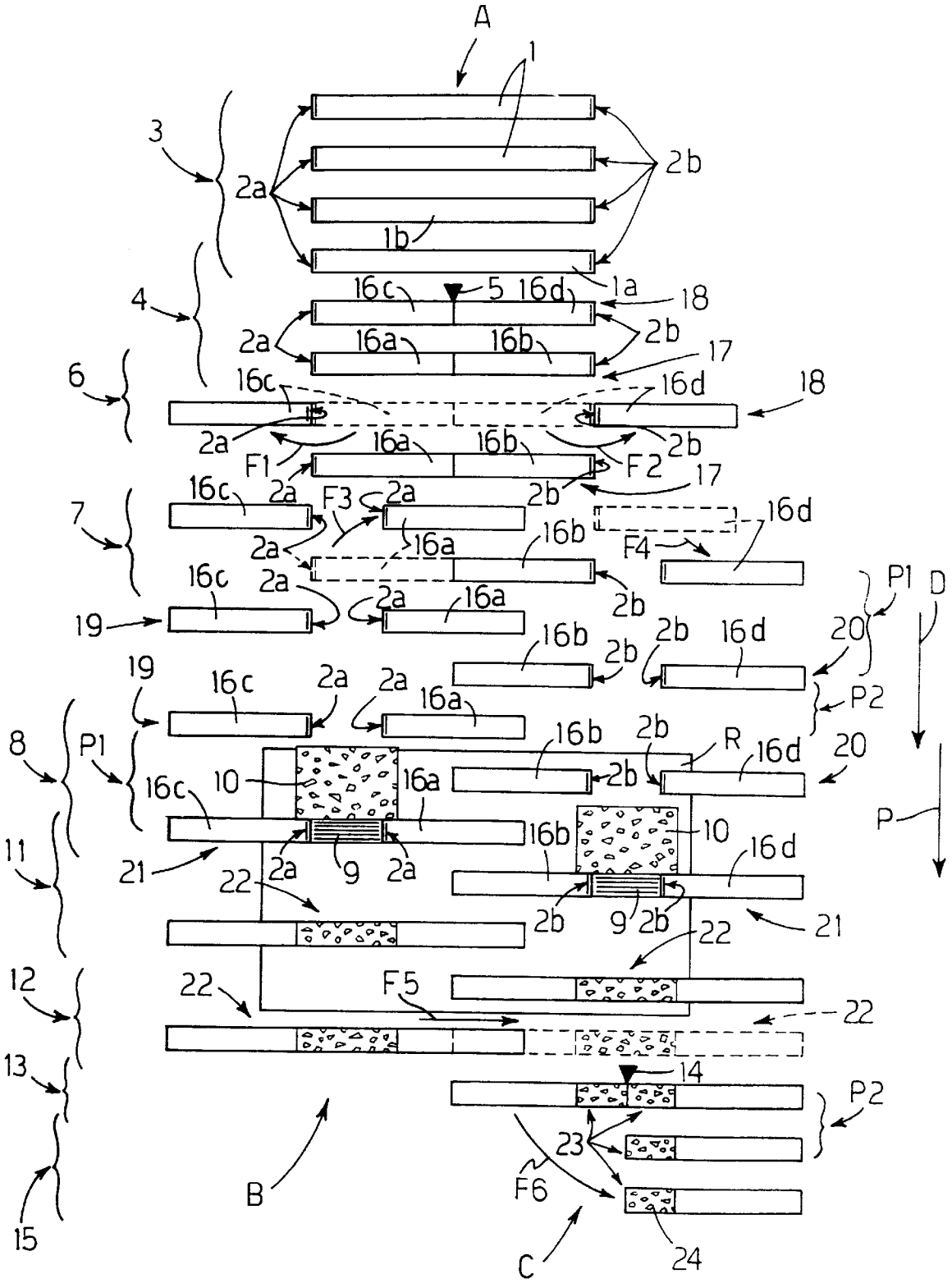
A
1
3
2a
2b
1b
1a
4
16c
5
16d
18
16a
16b
17
6
F1
F2
7
F3
F4
P1
D
19
20
P2
8
R
P
11
21
22
9
10
12
F5
13
14
23
F6
15
B
C
24

METHOD OF ROLLING CIGARETTE PORTIONS

BACKGROUND OF THE INVENTION

The present invention relates to a method of rolling cigarette portions.

In the tobacco industry, filter-tipped cigarettes are known to be formed using a method comprising the steps of forming, on a manufacturing machine, a continuous cigarette rod of tobacco enclosed in a tubular wrapping; cutting double cigarette portions off the cigarette rod, i.e. cigarette portions twice the length of the cigarette portion of a finished filter-tipped cigarette; and transferring the double cigarette portions to the input drum of a filter-assembly machine by means of a transfer device. On the filter-assembly machine, the double cigarette portions are arranged parallel and fed, in a single orderly succession and in a direction crosswise to their respective axes, to a cutting station where they are cut in half into pairs of single cigarette portions still arranged in said orderly succession. The single cigarette portions in each pair are then parted a given distance to receive, in between, a double filter and a band projecting between the two cigarette portions, and so form a group comprising a double filter, two single cigarette portions on either side of the double filter, and a projecting band. Each group is then rolled along a rolling path to wind the band about the double filter and respective ends of the single cigarette portions, and so form a double filter-tipped cigarette, which is then cut in half into a pair of single filter-tipped cigarettes.

Though still used successfully on many currently marketed machines, the above method is limited on account of rolling the groups along a rolling path resulting in tobacco fallout from the ends of the cigarette portions; which fallout is directly proportional to the rolling speed of the groups, and is therefore kept within acceptable limits by reducing the rolling speed and hence the output of the filter-assembly machine.

Increasing output by reducing the spacing of the groups is only possible up to a certain point, which is determined by the length of the projecting band, and beyond which one group would be superimposed on the band of the preceding group.

To overcome this drawback, Patent Application GB-A-2302791 provides for feeding a succession of double cigarette portions along a given plane to a cutting station where the double cigarette portions are cut to form a succession of pairs of single cigarette portions in said plane. The succession of pairs of single cigarette portions is then divided into two orderly successions, which are fed along separate superimposed planes for supply, together with respective double filters and respective bands, to respective superimposed rolling tracks to form two separate successions of double cigarettes.

This solution provides for high output of the filter-assembly machine, while at the same time halving rolling speed and so maintaining an acceptable degree of tobacco fallout. On the other hand, feeding the two successions of pairs of single cigarette portions along separate, substantially superimposed planes calls for at least three additional drums—as compared with a conventional filter-assembly machine with a rolling path extending in a single plane—thus complicating the design and increasing the production cost of the filter-assembly machine.

An alternative solution in U.S. Pat. No. 4,841,993 provides for supplying a filter-assembly machine with two parallel orderly successions of side by side double cigarette portions; cutting the double cigarette portions into pairs of single cigarette portions arranged in said two parallel orderly successions, in which each pair in one succession is coaxial with a pair in the other succession; supplying the respective filters and bands to form groups arranged in said two successions; and rolling the groups along a common rolling path to form two successions of double cigarettes.

Alongside the advantages provided by the above mentioned method, the same method also involves several drawbacks by calling for twice the axial length of the rolling drum and rolling track, thus resulting in problems as regards support of the drum—which, as is known, projects to allow troublefree access to the components of the filter-assembly machine—and the precision with which the groups are rolled. In other words, a long drum calls for highly accurate supports to prevent misalignment of the drum, and wear of the supports rapidly impairs precision, thus resulting in damage to the cigarette portions in direct proportion to the distance between the cigarette portions and the support.

SUMMARY OF THE INVENTION

It is an object of the present invention to provide a method of rolling cigarette portions, designed to minimize the aforementioned drawbacks.

According to the present invention, there is provided a method of rolling cigarette portions, the method comprising the steps of advancing a first succession of first pairs of cigarette portions in a direction crosswise to the respective axes of the cigarette portions, each first pair comprising a first and a second cigarette portion coaxial with and a given distance from each other; advancing a second succession of second pairs of cigarette portions in a direction crosswise to the respective axes of the cigarette portions, said second succession being parallel to the first succession, each second pair comprising a third and a fourth cigarette portion coaxial with and said given distance from each other, and the second cigarette portion in the first succession being adjacent to the third cigarette portion in the second succession; feeding a double filter and a respective band, projecting with respect to said double filter, between the first and second cigarette portion and between the third and fourth cigarette portion to form respective groups, each comprising a pair of cigarette portions, a double filter, and a band; and rolling said groups, arranged in said first and said second succession, to wind said bands about the respective double filters and about the ends of the respective cigarette portions to form double filter-tipped cigarettes; the method being characterized by comprising the step of partially engaging, combfashion, said first pairs in the first succession and said second pairs in the second succession in a relative position in which each third cigarette portion is located between two adjacent second cigarette portions, before said groups are rolled.

BRIEF DESCRIPTION OF THE DRAWING

A non-limiting embodiment of the present invention will be described by way of example with reference to the accompanying drawing, which shows, schematically, a sequence of operations performed on a filter-assembly machine implementing a preferred embodiment of the method according to the invention.

DETAILED DESCRIPTION OF THE INVENTION

Number 1 in the accompanying drawing indicates a number of double cigarette portions, which are fed in a direction D, crosswise to their respective longitudinal axes, along a path P defined by a succession of known suction conveyor rollers (not shown) of a filter-assembly machine (not shown). Path P lies in a plane G defined by the surface of the rollers (not shown) and coincident with the plane of the accompanying schematic drawing. Each portion 1 is substantially cylindrical, and has two opposite ends 2*a*, 2*b* formed by two successive cuts at a cutting station (not shown) of a cigarette manufacturing machine (not shown).

Along path P are arranged successively: a supply station 3; a cutting station 4 comprising a cutter 5; a tip turning station 6; a pairing station 7; a station 8 for inserting double filters 9 and respective projecting gummed bands 10; a rolling station 11 comprising a rolling bed R; an axial-transfer station 12; a cutting station 13 comprising a cutter 14; and a tip turning station 15.

In actual use, portions 1 are transferred to supply station 3 by a transfer device (not shown) connecting the manufacturing machine (not shown) to the filter-assembly machine (not shown). Portions 1 are fed by said transfer device (not shown) successively and in equally spaced manner in direction D to the input of the filter-assembly machine (not shown) and are fed in an orderly succession A, still in direction D and by said conveyor rollers (not shown) through cutting station 4 where cutter 5 cuts each double portion 1 in to two single cigarette portions 16.

For the sake of simplicity, reference will be made in the following description to two consecutive double portions 1*a* and 1*b*, double portion la preceding double portion 1*b* with reference to traveling direction D. Portions 1*a* and 1*b* are arranged alternately in succession A, and are fed through cutting station 4 where cutter 5 cuts portion 1*a* in half to form a pair 17 of single portions 16*a*, 16*b*, and cuts portion 1*b* in half to form a pair 18 of single portions 16*c*, 16*d*.

Pairs 17 and 18 are arranged in orderly fashion in succession A, and are fed through tip turning station 6 where portions 16*a*, 16*b* in pair 17 are maintained coaxial and contacting each other end to end with respective ends 2*a*, 2*b* facing outwards, while portions 16*c*, 16*d* in pair 18 are turned over through 180° in opposite directions F1, F2, and positioned, in the same plane, coaxial with each other, separated by a distance substantially equal to the length of a double portion 1, and with respective ends 2*a*, 2*b* facing each other.

Pairs 17 and 18 of portions 16*a*, 16*b*, 16*c*, 16*d* are fed in the above configuration to pairing station 7 where portions 16*c*, 16*b* are kept in the same position with respect to each other and the conveyor roller (not shown), while portion 16*a* is moved, in the same plane, in the opposite direction to direction D into a position coaxial with portion 16*c*, and also in a direction perpendicular to direction D into a position separated by a given distance of amount (L) from portion 16*c*. The displacement in said two directions is indicated in the accompanying drawing by arrow F3.

In substantially the same way, portion 16*d* is moved, in plane G, in the same direction as direction D into a position coaxial with portion 16*b*, and also in a direction perpendicular to direction D into a position separated by a given distance of amount (L) from portion 16*b*. In the accompanying drawing, the displacement in said two directions is indicated by arrow F4; portions 16*a*, 16*d* indicated by the dash lines are those prior to displacements F3, F4; and portions 16*a*, 16*d* indicated by the continuous lines are those after displacements F3, F4.

In the above configuration, portions 16*a*, 16*b*, 16*c*, 16*d* form a pair 19 of coaxial portions 16*c*, 16*a* separated by a given distance of amount (L), and a pair 20 of coaxial portions 16*b*, 16*d* separated by a given distance of amount (L); and pairs 19 and 20 are fed in direction D in two successions B and C with the same spacing P1, and partially engage one another, combfashion, by a length smaller than the length of a single portion 16. That is, portion 16*b* of one pair 20 is partially inserted between two portions 16*a* of two consecutive pairs 19 in direction D, and portion 16*a* of one pair 19 is partially inserted between two portions 16*b* of two consecutive pairs 20 in direction D. Moreover, each pair 19 is offset with respect to each adjacent pair 20 by a spacing P2 equal to half spacing P1.

The two successions B, C of respective pairs 19, 20 are fed through station 8 where double filters 9 and respective projecting bands 10 are fed onto plane G and inserted between portions 16*c* and 16*a* of pairs 19, and between portions 16*b* and 16*d* of pairs 20 to form groups 21 arranged in successions B and C. In station 8, the position of portions 16*a*, 16*b*, 16*c*, 16*d* remains unchanged, so that groups 21 in successions B and C are also engaged combfashion in the same way as pairs 19 and 20, and the bands 10 projecting with respect to respective filters 9, i.e. the bands 10 laid out flat, do not interfere with groups 21 in the adjacent succession B, C. Moreover, spacing P1 is greater than the length of band 10 laid out flat in direction D, to prevent the band from interfering with the next group 21 in the same succession B, C.

Groups 21, arranged as described, are fed inside station 11 by rolling groups 21 about their respective axes along common rolling bed R to wind bands 10 about respective double filters 9 and about ends 2*a* of portions 16*c*, 16*a* and ends 2*b* of portions 16*b*, 16*d* to form double filter-tipped cigarettes 22. Common rolling bed R is of a width, measured crosswise to direction D, equal to less than twice the length of a group 21, and, in a preferred embodiment, is of a width, measured crosswise to direction D, approximately equal to but no less than twice the width of band 10 plus twice the length of one portion 16*a*, 16*b*, 16*c*, 16*d*.

Double filter-tipped cigarettes 22, arranged in successions B and C and engaged combfashion in the same way as groups 21, are fed to station 12, where double cigarettes 22 in succession B are shifted axially and perpendicularly to direction D, as shown by arrow F5, to position double cigarettes 22 of succession B between the double cigarettes of succession C and so form a single succession C in which double filter-tipped cigarettes 22 are equally spaced with spacing P2 equal to half spacing P1. In the accompanying drawing, one double cigarette 22 at station 12 is indicated by a continuous line in succession B and by a dash line in succession C.

Double cigarettes 22 in single succession C are fed through cutting station 13 where cutter 14 cuts double filter 9 of each double cigarette 22 in half to form a pair of single filter-tipped cigarettes 23, each comprising a single cigarette portion 16*a*, 16*b*, 16*c*, 16*d* attached to a single filter 24 formed by cutting respective double filter 9 in half. The cigarettes 23 in each pair are positioned with respective filters 24 facing and adjacent to each other.

At tip turning station 15, one cigarette 23 in each pair is turned over through 180°, in the direction of arrow F6, into a position parallel to and side by side with the other cigarette 23 in the same pair, so as form a single succession of equioriented cigarettes 23, i.e. with respective filters 24 all facing the same way.

What is claimed is:

1. A method of rolling cigarette portions, the method comprising the steps of advancing a first succession of first pairs of cigarette portions in a direction crosswise to the respective axes of the cigarette portions each first pair comprising a first and a second cigarette portion coaxial with and a given distance from each other; advancing a second succession of second pairs of cigarette portions in a direction crosswise to the respective axes of the cigarette portions, said second succession being parallel to the first succession, each second pair comprising a third and a fourth cigarette portion coaxial with and said given distance from each other, and the second cigarette portion in the first succession being adjacent to the third cigarette portion in the second succession; partially engaging, combfashion, said first pairs in the first succession and said second pairs in the second succession by partially inserting said third cigarette portion of each second pair between two second cigarette portions of two consecutive first pairs; feeding a double filter and a respective band, projecting with respect to said double filter, between the first and second cigarette portion and between the third and fourth cigarette portion to form respective groups, each comprising a pair of cigarette portions a double filter, and a band; and rolling said groups, arranged in said first and said second succession, to wind said bands about the respective double filters and about the ends of the respective cigarette portions to form double filter-tipped cigarettes.

2. A method as claimed in claim 1, characterized in that said first and second pairs (19, 20) are engaged combfashion by a length less than the length of a said cigarette portion (16*a*, 16*b*, 16*c*, 16*d*).

3. A method as claimed in claim 1, characterized in that the groups (21) in said first and second successions (B, C) are rolled along a common rolling bed (R).

4. A method as claimed in claim 3, characterized in that said common rolling bed (R) is of a width, measured crosswise to said direction (D), equal to less than twice the length of a said group (21).

5. A method as claimed in claim 3, characterized in that said common rolling bed (R) is of a width, measured crosswise to said direction (D), approximately equal to but no less than twice the width of a said band (10) plus twice the length of a said cigarette portion (16*a*, 16*b*, 16*c*, 16*d*).

6. A method as claimed in claim 1, characterized in that successive cigarette portions (16*a*, 16*b*, 16*c*, 16*d*) in the same succession (B, C) are equally spaced with a spacing (P1) at least equal to the length of a said band (10).

* * * * *